US006637562B2

(12) United States Patent
Oh

(10) Patent No.: US 6,637,562 B2
(45) Date of Patent: Oct. 28, 2003

(54) LUGGAGE WITH INTEGRATED COVER

(75) Inventor: Scott Oh, Carson, CA (US)

(73) Assignee: Luggage America, Inc., Carson, CA (US)

( * ) Notice: Subject to any disclaimer, the term of this patent is extended or adjusted under 35 U.S.C. 154(b) by 0 days.

(21) Appl. No.: 10/032,938

(22) Filed: Dec. 26, 2001

(65) Prior Publication Data

US 2003/0116392 A1 Jun. 26, 2003

(51) Int. Cl.[7] ..... A45C 5/06; A45C 5/14; A45C 13/00

(52) U.S. Cl. ..... 190/26; 190/18 A; 190/102; 150/105

(58) Field of Search ..... 150/103, 105, 150/154; 383/111; 190/26, 1, 100, 101, 102, 109, 111, 112, 125

(56) References Cited

U.S. PATENT DOCUMENTS

| | | | | | |
|---|---|---|---|---|---|
| 656,707 | A | * | 8/1900 | Welshe | 190/26 |
| 1,526,839 | A | * | 2/1925 | Dempsey | 190/125 X |
| 2,432,365 | A | * | 12/1947 | Allen | 190/26 X |
| 2,693,259 | A | * | 11/1954 | Amick | 190/26 |
| 2,724,467 | A | * | 11/1955 | Jaffe | 190/26 |
| 4,026,339 | A | * | 5/1977 | Burke | 383/111 X |
| 5,060,767 | A | * | 10/1991 | Pulichino, Jr. et al. | 190/109 X |
| 5,154,332 | A | * | 10/1992 | Williams et al. | 190/26 X |
| 5,255,765 | A | * | 10/1993 | Schrecongost | 190/26 |
| 5,330,037 | A | * | 7/1994 | Wang | 190/18 A |
| 5,439,153 | A | * | 8/1995 | Murdoch et al. | 150/159 X |
| 5,498,010 | A | * | 3/1996 | Stube | 190/18 A |
| 5,507,332 | A | * | 4/1996 | McKinnon | 150/159 |
| 5,676,223 | A | * | 10/1997 | Cunningham | 190/109 |
| 5,718,333 | A | * | 2/1998 | Armour | 150/159 X |
| 5,967,270 | A | * | 10/1999 | Shyr | 190/109 |
| 6,098,768 | A | * | 8/2000 | Tsai | 190/109 X |
| 6,279,796 | B1 | * | 8/2001 | Trevino | 150/154 X |
| 6,315,178 | B1 | * | 11/2001 | Nobata | 190/26 X |

FOREIGN PATENT DOCUMENTS

| | | | | |
|---|---|---|---|---|
| FR | 1085191 | * | 1/1955 | 190/111 |
| GB | 911834 | * | 11/1962 | 190/109 |
| GB | 2147497 | * | 5/1985 | 190/100 |
| GB | 2253781 | * | 9/1992 | 150/154 |
| JP | 3289903 | * | 12/1991 | |

* cited by examiner

*Primary Examiner*—Sue A. Weaver
(74) *Attorney, Agent, or Firm*—Lee, Hong, Degerman, Kang & Schmadeka

(57) ABSTRACT

An improved luggage container with an integrated cover comprises a first compartment having at least front, rear and side surfaces and a second compartment formed on the backside of the first compartment. The second compartment has a cover defining and providing access to the integrated luggage cover that is permanently affixed to the inside layer of the second compartment. The integrated luggage cover is comprised of a water resistive material and, upon extraction from the second compartment, is deployed to form a protective shell around the first compartment. A permanently affixed cover facilitates the user's need to protect the luggage container in an efficient and convenient manner.

13 Claims, 6 Drawing Sheets

LUGGAGE WITH INTEGRATED COVER

BACKGROUND OF THE INVENTION

1. Field of the Invention

The present invention relates generally to luggage containers, and more particularly, a luggage container with an integrated cover.

2. Description of the Related Art

There has always been a need to protect one's luggage from exposure to natural elements, general wear-and-tear, and overall deterioration, just as there always been a need for luggage to effectively protect the contents placed within. The need to protect luggage from such conditions has increased more so due to the rising cost of quality-crafted luggage and subsequent maintenance. These costs are compounded by the fact that some luggage items are manufactured with perishable materials such as leather and are subject to a higher rate of deterioration.

Prior art has shown the use of protective covers for various items including luggage to increase the useful life of the product. However, such covers for luggage are often separate and detached. Consequently, the luggage user must constantly be aware of the environmental conditions that his luggage may be exposed to. Should weather conditions worsen, the user must then immediately extract the cover and encase the luggage item for protection. Normally, effective luggage covers are bulky and awkward and, due to their relatively large surface areas, the covers often occupy large amounts of valuable space within the main compartments of the luggage containers if transported. Subsequently the user is required to open the main compartment in transit, search for and extract the cover, and finally deploy it. This time consuming process allows for further exposure of the luggage container to the elements.

In addition, these covers are not likely to be tailored to the dimensions of the luggage item. Accordingly, a cover may prove to be too small (in the case of a large suitcase) or too large (in the case of smaller "carry-on" luggage) for the luggage container it is attempting to protect. Should a cover be too small for the intended luggage item, a portion of the luggage may remain exposed. The resulting disparity in deterioration between the exposed and covered areas of the luggage item may detract from the aesthetic and physical qualities of the luggage item. Also, during transport, the leading edge of the undersized cover may allow the cover to become caught on protruding objects. This situation also arises for protective covers that may be too large for its intended luggage container, where loose portions of the cover may get snagged or get caught in moving parts such as a luggage conveyor system at an airport.

Prior art has attempted to address the concern of better fitting covers for luggage containers. U.S. Pat. No. 6,279,796 issued to Trevino on Aug. 28, 2001 illustrates the use of a drawstring in covers incorporated into backpacks. This system may work well with backpacks and smaller luggage containers which can be handled easily without requiring the container to be set down and allow for a facet of the container to be exposed. However, bulkier luggage containers such as suitcases require covers with more robust means of enclosing the container than drawstrings. During transport and handling, bulkier luggage containers would create undue pressure against the contraction provided by the drawstring, thus expanding the aperture and allowing a portion of the luggage to be exposed. Should the perimeter controlled by the drawstrings be great enough, the luggage container could slip out from within the cover.

Although various attempts have been made to solve the problem of effectively covering a luggage container, as cost and extravagance of luggage containers increase, an improved design is required. The present invention is designed to provide a luggage system whose aesthetic nature and durability are effectively protected without inconveniencing the user.

SUMMARY OF THE INVENTION

Accordingly, the present invention is directed to an improved luggage that substantially obviates one or more of the problems due to limitations and disadvantages of the related art.

An object of the present invention is to ensure that the luggage user has convenient and efficient access to the protective cover for that luggage.

To achieve these and other advantages and in accordance with the purpose of the present invention, as embodied and broadly described, a luggage container with an integrated cover comprises a first compartment having at least front, rear and side surfaces; a second compartment formed on the rear side surface of the first compartment; wherein the second compartment has a cover defining and providing access to the second compartment; and a protective cover made of weatherproof material attached inside the second compartment, the protective cover forming a shell encompassing the first compartment such that the cover is extracted and deployed from the opened second compartment, and when the second compartment is closed, the cover is enclosed within the second compartment.

According to one aspect of the preferred embodiment, the integrated protective cover contains apertures for access to handles located on the luggage container and apertures for wheels located on the bottom of the luggage container to function while the protective cover is deployed.

According to another aspect of the preferred embodiment, the protective cover is made of water resistive material.

In an alternative embodiment of the present invention, the second compartment is formed on the first side surface of the first compartment.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. Therefore, it is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

Hereinafter, the present invention will be described with respect to the preferred embodiment illustrated in the annexed drawings.

Figure 1:
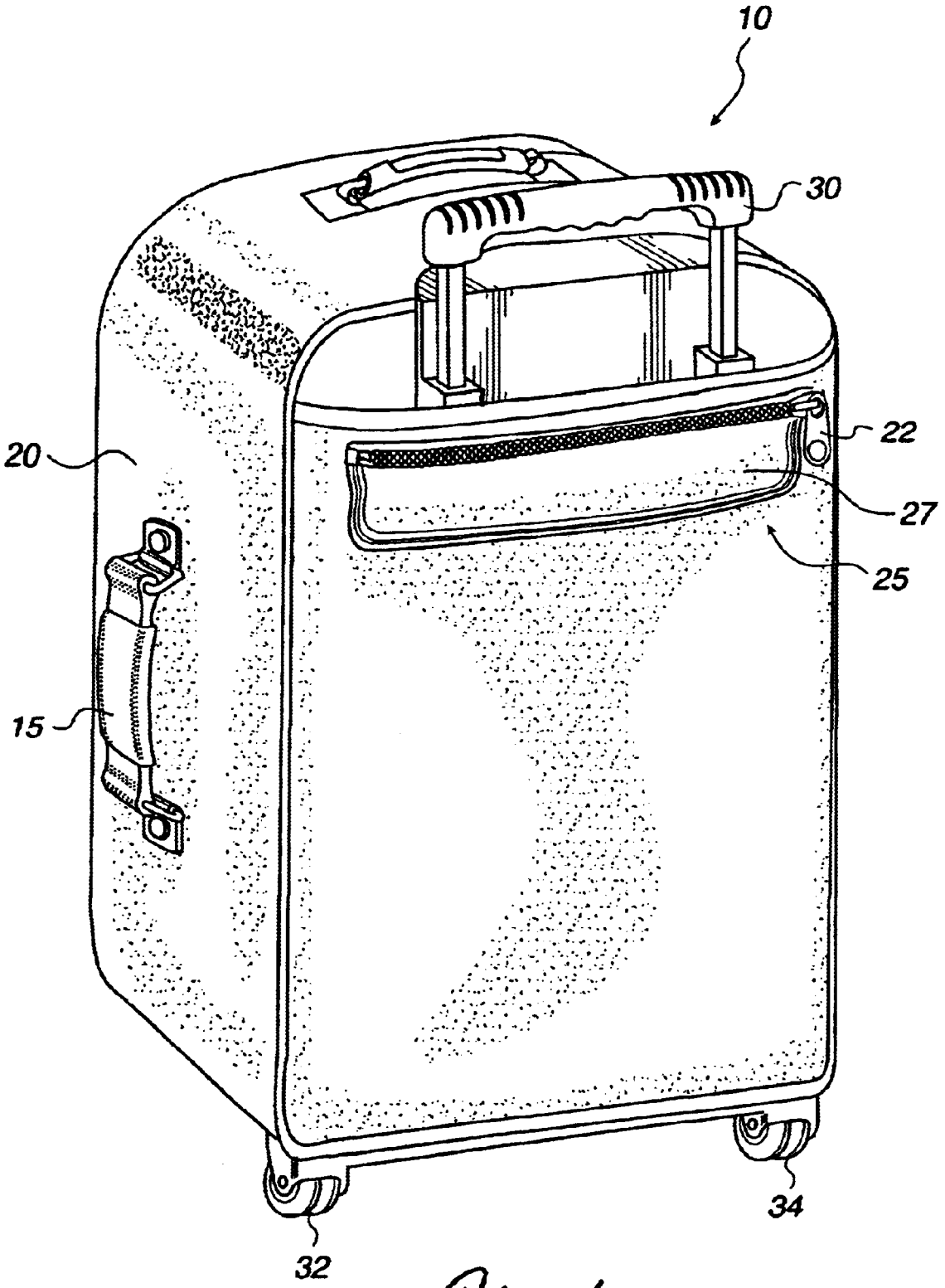
FIG. 1 illustrates a perspective view of the luggage container with the integrated cover stored in a compartment attached to the rear of the luggage container in accordance with a preferred embodiment of the present invention.

FIG. 1 illustrates a perspective view of the luggage container 10 having an integrated cover holder in accordance with a preferred embodiment of the present invention. According to FIG. 1, the luggage 10 has at least two compartments 20 and 25, wherein the main compartment 20 is used to keep the user's belongings, while a second or side compartment 25 is used to hold an integrated cover (not shown) that protects the luggage container from the elements. The cover is accessible preferably by using a zipper 22. However, other suitable methods of closing the compartment 25 may also be used. The luggage 10 has a non-extendable handle 15 centrally mounted on the second side surface as well as an extendable handle 30. The retractable handle 30 extends substantially along the length of the luggage 10. The extendable handle 30 is mounted on the main compartment 20 at a position that is adjacent to the backside of the main compartment 20. In the wheeled suitcase configuration, the handle 30 extends out of the top of the main compartment 20 to predetermined distance and used by the user to pull the luggage 10 by rolling the wheels 32, 34 after tilting the luggage 10.

The second compartment 25 is preferably placed on the backside of the luggage 10 and adjacent with respect to width to the base of the handle 30. The second compartment 25 has a cover 27 that preferably opens on top. The cover 27 closes the second compartment 25 by using any suitable fastener known to one of ordinary skill in the art, such as zippers, snaps, hook and loop fasteners or the like. According to the preferred embodiment, the second compartment 25 is opened and closed using a zipper 22 as a fastener. The second compartment 25 also includes an inner layer (not shown) and is made of a water resistant material to protect the materials stored inside the main compartment 20 due to possible debris and liquids deposited on the integrated cover when stored within the second compartment 25. The inner layer of the second compartment 25 is preferably shared with the lining of the main compartment 20. However, this is not necessary and each compartment may have a separate lining.

In the preferred embodiment of the present invention, the luggage 10 can be formed of any durable material, such as canvas, fabric, nylon, leather, plastic (e.g. vinyl), etc.

Figure 2:
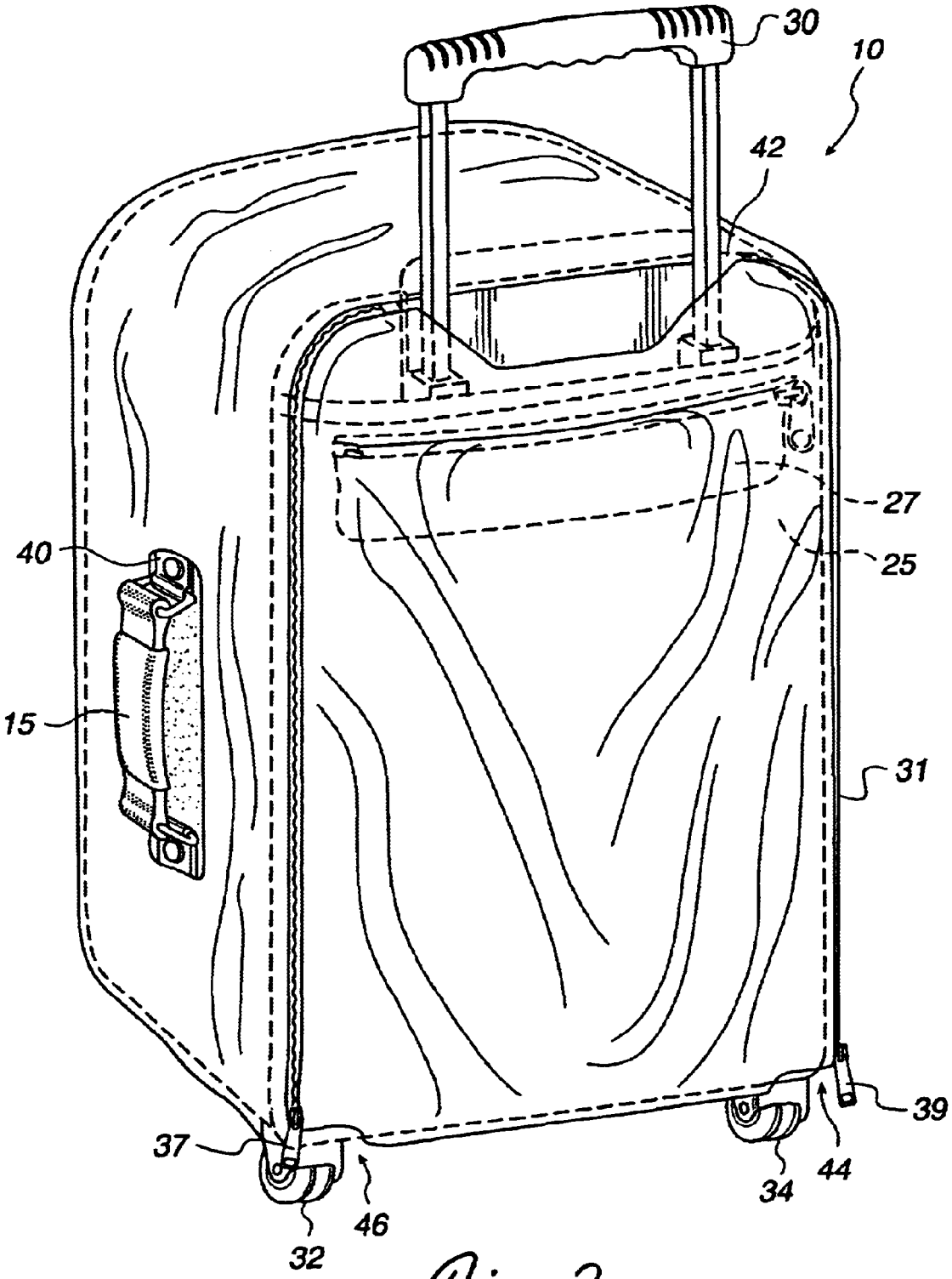
FIG. 2 illustrates a perspective view of the luggage container enclosed within the integrated cover in accordance with the preferred embodiment of the present invention.
Figure 3:
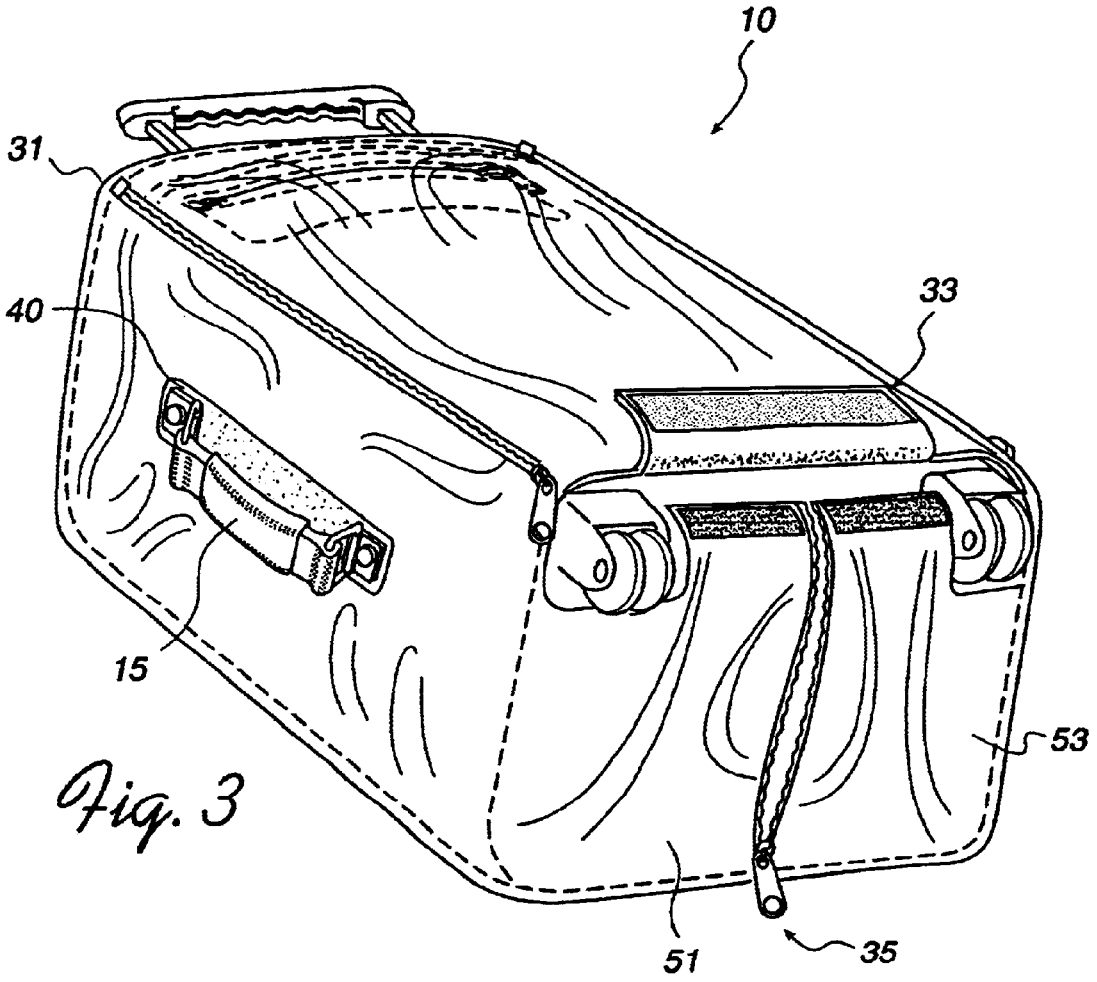
FIG. 3 illustrates a bottom perspective view of the luggage container enclosed within the integrated cover in accordance with the preferred embodiment of the present invention.

FIGS. 2 and 3 are a rear perspective and bottom perspective views, respectively, of the wheeled luggage 10 with the cover 27 for the second compartment 25 opened in accordance with the preferred embodiment of the present invention. The integrated cover 31, enclosing the luggage 10, is permanently affixed to the inner layer of the second compartment 25. The integrated cover 31 is comprised of any water resistive material but preferably made of nylon or vinyl. The integrated cover 31 is preferably stitched to the inside layer of the second compartment 25 or is fastened by using any suitable fastener known to one of ordinary skill in the art, such as snaps, hook and loop fasteners or the like. The integrated cover 31 has apertures 40, 42, 44 and 46 to allow access to the handles 15, 30 and the wheels 34, 32, respectively. Two zippers 37, 39 are located on the rear side edges of the cover 31 fasten along the length of the cover 31 to further secure it. Another zipper 35 located on the bottom side of the cover 31 fastens the shaped bottom panels 51 and 53 of the cover 31 by running from the front bottom edge to rear bottom edge of the cover 31. The apertures 44 and 46 are created by fastening rear bottom edge of the cover 31 to the shaped bottom panels 51 and 53 of the cover 31 with hook and loop fasteners 33.

Figure 4:
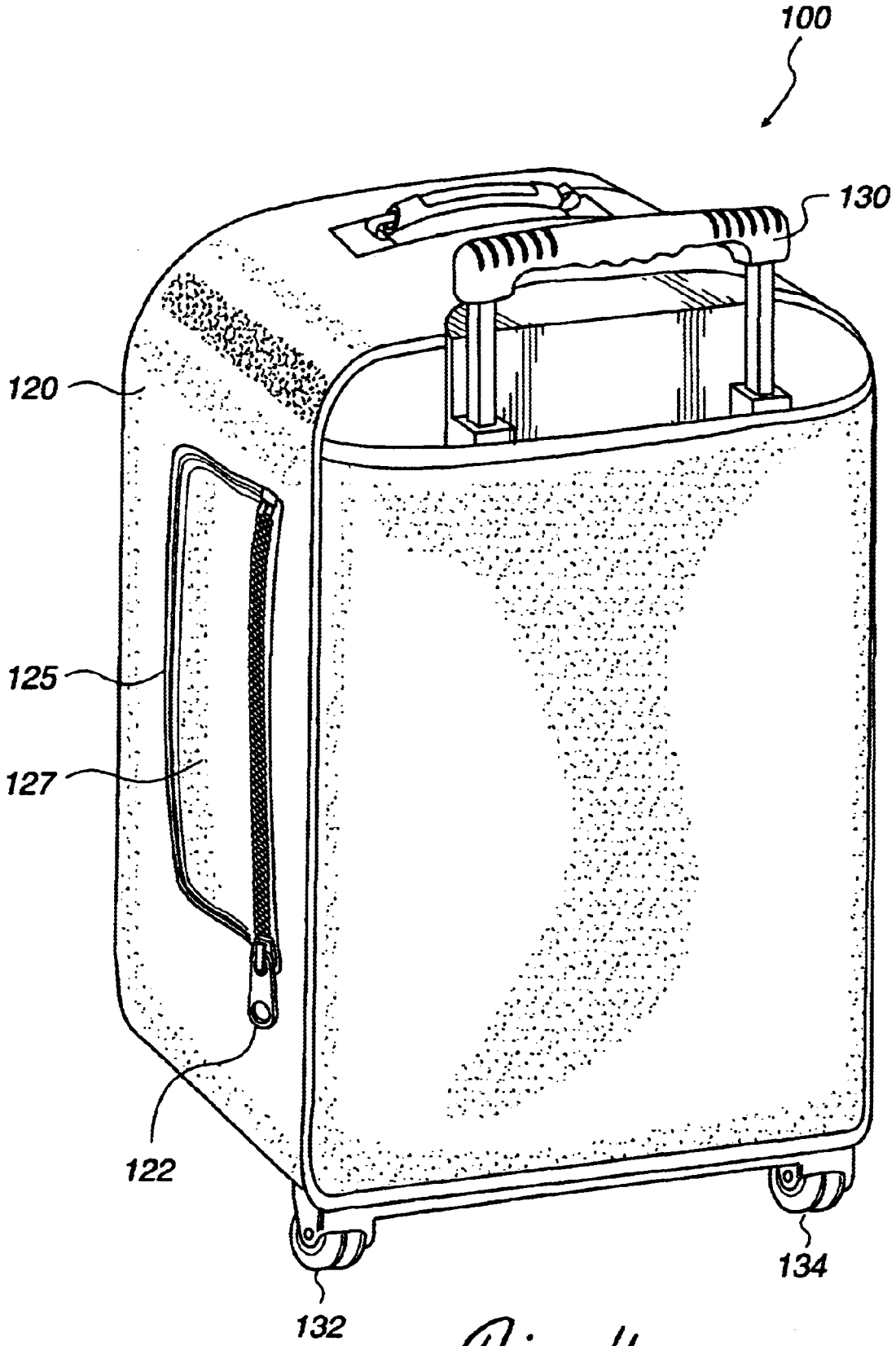
FIG. 4 illustrates a rear perspective view of the luggage container with the integrated cover stored in a compartment located on the side of the container in accordance with an alternative embodiment of the present invention.

FIG. 4 illustrates a perspective views of the luggage container 100 with the integrated cover stored in accordance with an alternative embodiment of the present invention. According to FIG. 4, the luggage 100 has at least two compartments 120 and 125, wherein the main compartment 120 is used to keep the user's belongings, while a second or side compartment 125 is used to hold an integrated cover (not shown) that protects the luggage container from the elements. The cover is accessible preferably by using a zipper 122. However, other suitable methods of closing the compartment 125 may also be used. The luggage 100 has a non-extendable handle centrally mounted on the second side surface (not shown) as well as an extendable handle 130. The retractable handle 130 extends substantially along the length of the luggage 100. The extendable handle 130 is mounted on the main compartment 120 at a position that is adjacent to the backside of the main compartment 120. In the wheeled suitcase configuration, the handle 130 extends out of the top of the main compartment 120 to predetermined distance and used by the user to pull the luggage 100 by rolling the wheels 132, 134 after tilting the luggage 100.

The second compartment 125 is placed, preferably centrally, on the first side surface of the luggage 100. The second compartment 125 has a cover 127 that closes the second compartment 125 by using any suitable fastener known to one of ordinary skill in the art, such as zippers, snaps, hook and loop fasteners or the like. According to the preferred embodiment, the second compartment 125 is opened and closed using a zipper 122 as a fastener. The second compartment 125 also includes an inner layer (not shown) and is made of a water resistant material to protect the materials stored inside the main compartment 120 due to possible debris and liquids deposited on the integrated cover when stored within the second compartment 125. The inner layer of the second compartment 125 is preferably shared with the lining of the main compartment 120. However, this is not necessary and each compartment may have a separate lining.

In the alternative embodiment of the present invention, the luggage 100 can be formed of any durable material, such as canvas, fabric, nylon, leather, plastic (e.g. vinyl), etc.

Figure 5:
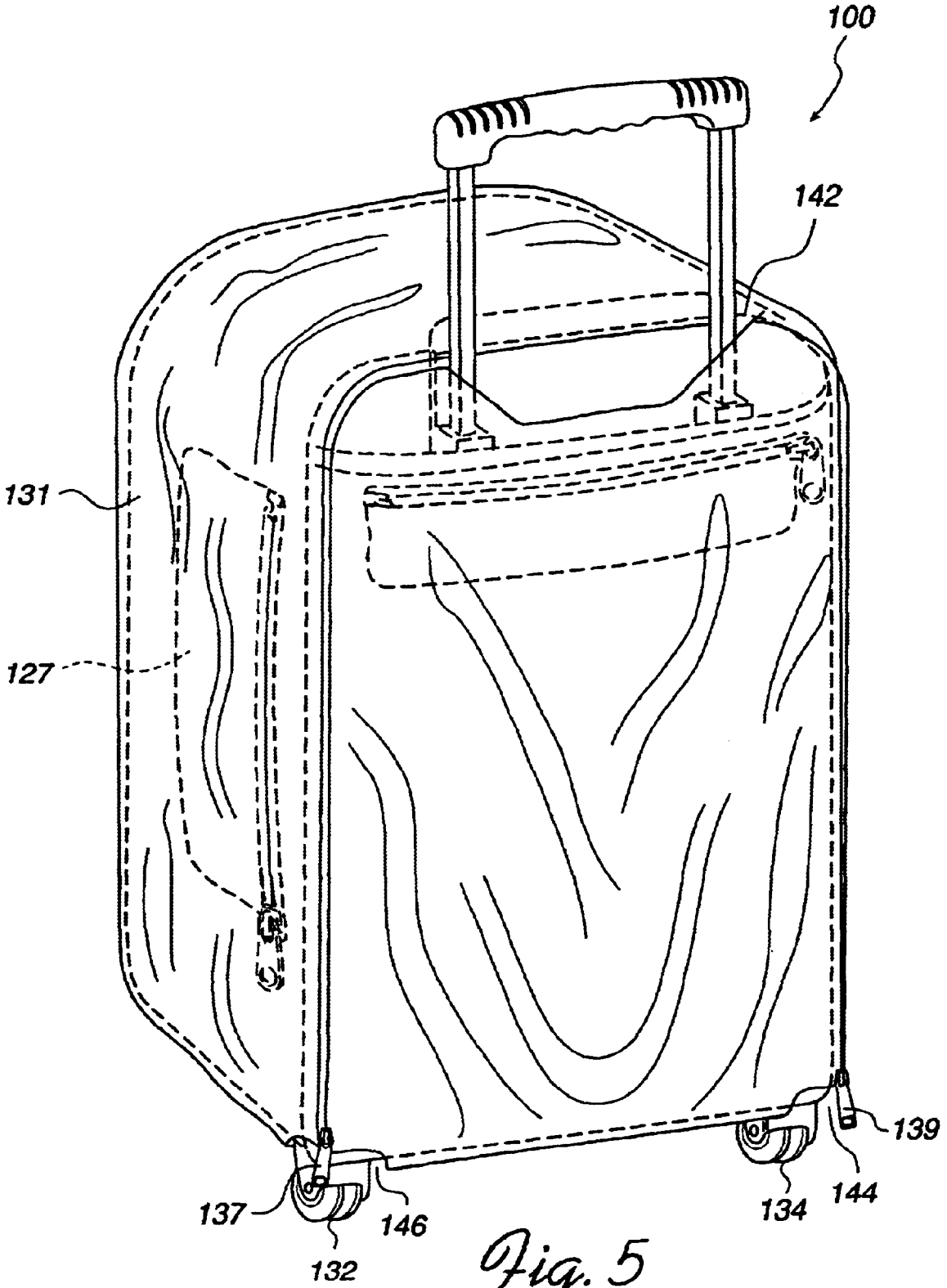
FIG. 5 illustrates a rear perspective view of the luggage container enclosed within the integrated cover in accordance with the alternative embodiment of the present invention.
Figure 6:
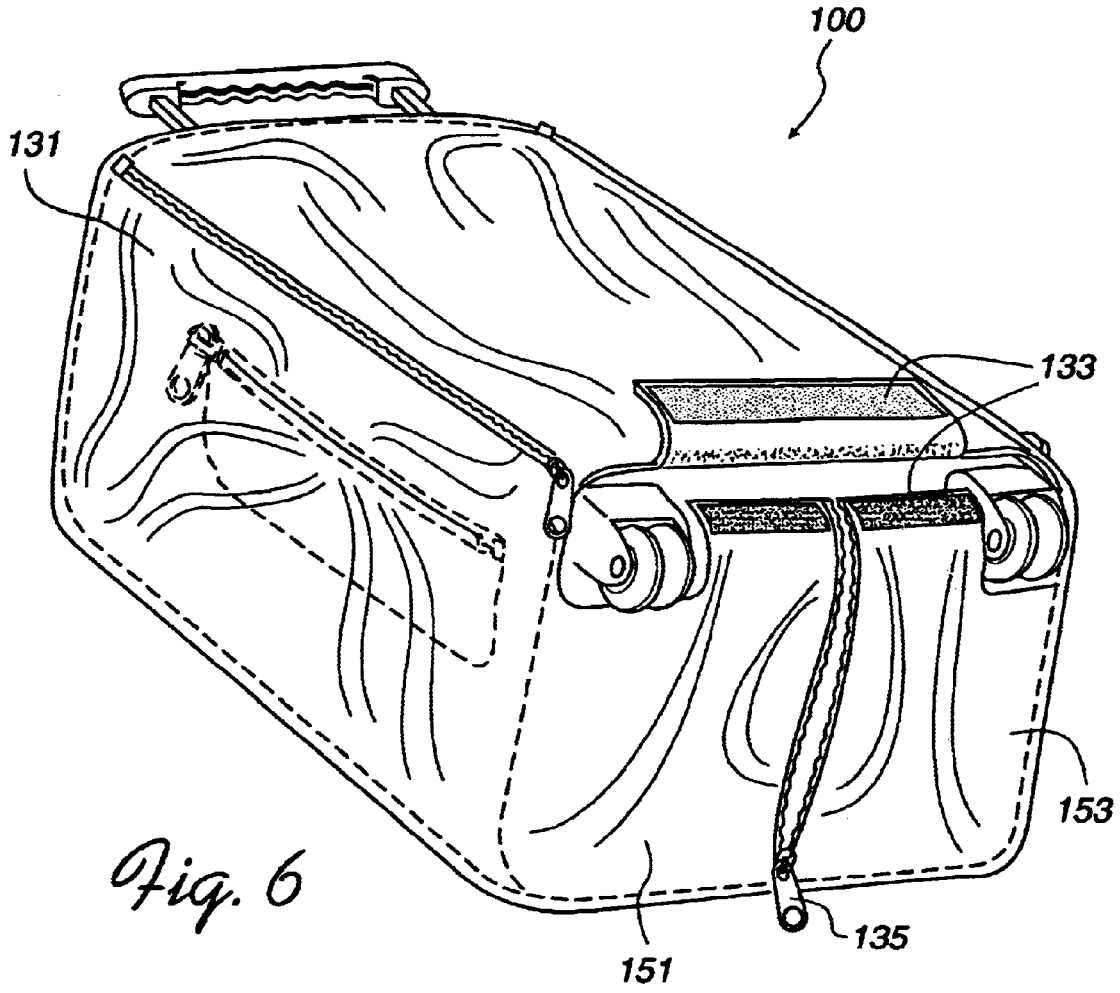
FIG. 6 illustrates a bottom perspective view of the luggage container enclosed within the integrated cover in accordance with the alternative embodiment of the present invention.

FIGS. 5 and 6 are a rear perspective and bottom perspective views, respectively, of the wheeled luggage 100 with the cover 127 for the second compartment 125 opened in accordance with the alternative embodiment of the present invention. The integrated cover 131, enclosing the luggage

100, is permanently affixed to the inner layer of the second compartment 125. The integrated cover 131 is comprised of any water resistive material but preferably made of nylon or vinyl. The integrated cover 131 is preferably stitched to the inside layer of the second compartment 125 or is fastened by using any suitable fastener known to one of ordinary skill in the art, such as snaps, hook and loop fasteners or the like. The integrated cover 131 has apertures 142, 144 and 146 to allow access to the handles 130 and the wheels 134, 132, respectively. Also, there is another aperture not shown located on the second side surface of the luggage 100 to allow access to the non-extendable handle. Two zippers 137, 139 are located on the rear side edges of the cover 131 fasten along the length of the cover 131 to further secure it. Another zipper 135 located on the bottom side of the cover 131 fastens the shaped bottom panels 151 and 153 of the cover 131 by running from the front bottom edge to rear bottom edge of the cover 131. The apertures 144 and 146 are created by fastening rear bottom edge of the cover 131 to the shaped bottom panels 151 and 153 of the cover 131 with hook and loop fasteners 133.

It will be apparent to those skilled in the art that various modifications and variations can be made in the present invention without departing from the spirit or scope of the invention. Therefore, the foregoing description of these embodiments of the present invention has been presented for the purposes of illustration and description. It is not intended to be exhaustive or to limit the invention to the precise form disclosed. Thus, it is intended that the present invention cover the modifications and variations of this invention provided they come within the scope of the appended claims and their equivalents. Preferred embodiments were shown in the context of standard wheeled luggage. In alternative embodiments, luggage of any size or containing a number of compartments can be substituted for the present invention.

What is claimed is:

1. A luggage container with an integrated cover, comprising:

a first compartment comprising front, rear, top, bottom and side surfaces;

a second compartment formed on the rear surface of the first compartment, wherein the second compartment defines an opening that provides access to the second compartment; and a protective cover fixed within the second compartment, wherein the protective cover forms a protective shell for covering the first compartment, is deployable through the opening of the second compartment, and comprises a plurality of panels detachably fastened to each other, wherein the plurality of panels comprise:

a top surface;

a plurality of side surfaces;

a rear surface having a length and detachably fastened to said side surfaces along the length of the rear surface; and a bottom surface having a width and detachably fastened to said rear surface along the width of the bottom surface.

2. The luggage container according to claim 1, wherein the plurality of side surfaces comprise an aperture for access to a handle on a side surface of the first compartment.

3. The luggage container according to claim 1, further comprising:

a handle disposed on the side surface of the first compartment; and a pair of wheels mounted to a lower end of the first compartment.

4. The luggage container according to claim 1, wherein the second compartment comprises an inner layer that is common to the rear surface of the first compartment, the inner layer being of a water resistive material.

5. The luggage container according to claim 1, wherein the protective cover is of a water resistive material.

6. The luggage container according to claim 1, wherein the top surface of the protective cover defines at least an aperture for access to a fixed handle.

7. A luggage container with an integrated cover, comprising:

a first compartment comprising front, rear, top, bottom and side surfaces;

a second compartment formed on a side surface of the first compartment, wherein the second compartment defines an opening that provides access to the second compartment; and a protective cover fixed within the second compartment, wherein the protective cover forms a protective shell for covering the first compartment, is deployable through the opening of the second compartment, and comprises a plurality of panels detachably fastened to each other, wherein the plurality of panels comprise:

a top surface;

a plurality of side surfaces;

a rear surface having a length and detachably fastened to said side surfaces along the length of the rear surface; and a bottom surface having a width and detachably fastened to said rear surface along the width of the bottom surface.

8. The luggage container according to claim 7, wherein the plurality of side surfaces comprise an aperture for access to a handle on a side surface of the first compartment.

9. The luggage container according to claim 7, further comprising:

a handle disposed on the side surface of the first compartment; and a pair of wheels mounted to a lower end of the first compartment.

10. The luggage container according to claim 7, wherein the second compartment comprises a layer that is common to the side surface of the first compartment, the inner layer being of a water resistive material.

11. The luggage container according to claim 7, wherein the protective cover is of a water resistive material.

12. The luggage container according to claim 7, wherein the top surface of the protective cover defines at least an aperture for access to a fixed handle.

13. A luggage container with an integrated cover comprising:

a first compartment comprising front, rear, top, bottom and side surfaces;

a second compartment formed on a surface of the first compartment, wherein the second compartment defines an opening that provides access to the second compartment; and a protective cover fixed within the second compartment, wherein the protective cover forms a protective shell for covering the first compartment and is deployable through the opening of the second compartment, wherein the protective cover comprises:

a top surface;

a plurality of side surfaces;

a rear surface having a length and detachably fastened to said side surfaces along the length of the rear surface; and a bottom surface having a width and detachably fastened to said rear surface along the width of the bottom surface.

* * * * *